US007309061B2

(12) United States Patent
Araki

(10) Patent No.: US 7,309,061 B2
(45) Date of Patent: Dec. 18, 2007

(54) DIAPHRAGM-TYPE CARBURETORS

(75) Inventor: Satoru Araki, Hachimantai (JP)

(73) Assignee: ZAMA Japan Co., Ltd., Iwate-Gun, Iwate-Ken (JP)

( * ) Notice: Subject to any disclaimer, the term of this patent is extended or adjusted under 35 U.S.C. 154(b) by 0 days.

(21) Appl. No.: 11/484,702

(22) Filed: Jul. 12, 2006

(65) Prior Publication Data

US 2007/0013085 A1 Jan. 18, 2007

(30) Foreign Application Priority Data

Jul. 13, 2005 (JP) ..... 2005-204546

(51) Int. Cl.
*F02M 17/04* (2006.01)

(52) U.S. Cl. ..... 261/35; 261/DIG. 19; 261/DIG. 81

(58) Field of Classification Search ..... 261/35, 261/DIG. 19, DIG. 81
See application file for complete search history.

(56) References Cited

U.S. PATENT DOCUMENTS

| | | | | |
|---|---|---|---|---|
| 3,037,751 | A * | 6/1962 | Phillips | 261/35 |
| 3,738,622 | A * | 6/1973 | Tuckey | 261/35 |
| 3,852,391 | A * | 12/1974 | Hisatomi et al. | 261/69.1 |
| 4,563,311 | A * | 1/1986 | Agnew | 261/35 |
| 4,752,420 | A * | 6/1988 | Nagasaka et al. | 261/35 |
| 4,770,822 | A * | 9/1988 | Sejimo | 261/35 |
| 4,824,613 | A * | 4/1989 | Scott et al. | 261/35 |
| 6,425,573 | B1 | 7/2002 | Suzuki | 261/35 |
| 6,439,546 | B1 * | 8/2002 | Galka | 261/4 |
| 6,595,500 | B2 * | 7/2003 | Osburg et al. | 261/34.2 |
| 6,644,631 | B2 | 11/2003 | Suzuki | 261/35 |
| 2002/0158349 | A1 * | 10/2002 | Osburg et al. | 261/34.2 |
| 2003/0102579 | A1 * | 6/2003 | Suzuki | 261/35 |

FOREIGN PATENT DOCUMENTS

| | | | | |
|---|---|---|---|---|
| GB | 2179701 | A * | 3/1987 | 261/DIG. 81 |
| JP | H09158806 | | 6/1997 | |
| JP | 2000297702 | | 10/2000 | |
| JP | 2003166444 | | 6/2003 | |

* cited by examiner

*Primary Examiner*—Richard L. Chiesa
(74) *Attorney, Agent, or Firm*—Baker Botts L.L.P.

(57) ABSTRACT

The carburetor prevents an air-fuel mixture from becoming excessively lean and prevents a fuel pressure from becoming unstable, thereby making it possible to stably supply a fuel to an engine, in a diaphragm-type carburetor with a pressure regulator. A diaphragm-type carburetor includes a fuel pump using a pulsation pressure generated in a crank chamber of an engine or an intake pipe as a driving force, and a metering chamber having a diaphragm and a lever mechanism and provided with fuel at a desired constant pressure. The diaphragm-type carburetor includes a bubble discharge path connecting the metering chamber to other predetermined discharge portions and with a check valve in each of an inlet side and an outlet side. A bubble removing pump is connected to the bubble discharge path, withdraws the bubble to the bubble discharge path from the metering chamber in conjunction with a closing or opening operation of a throttle shaft by a driver or operator and discharging the withdrawn bubble to the discharge portion in conjunction with an opening or closing operation of the throttle shaft.

10 Claims, 3 Drawing Sheets

DIAPHRAGM-TYPE CARBURETORS

BACKGROUND OF THE INVENTION

1. Field of the Invention

The present invention relates to diaphragm-type carburetors preferably for use in general purpose engines and provided with a metering chamber maintaining a desired fuel pressure by a diaphragm and a lever mechanism, and, more particularly, to diaphragm-type carburetors provided with a means for removing a bubble of a fuel vapor introduced to the metering chamber or generated within the metering chamber.

2. Description of Related Art

A diaphragm-type carburetor frequently is used for supplying a fuel to a general purpose engine, particularly, a general purpose engine having a small displacement, and an inner portion of such diaphragm-type carburetors generally is provided with a metering chamber (e.g., a constant pressure chamber) for obtaining a constant fuel pressure which provides a reference for fuel metering by a metering diaphragm and a metering lever mechanism.

Such a metering chamber may be filled only with a liquid fuel to achieve a stability of a pressure. Nevertheless, a fluctuation in a fuel discharge pressure by a fuel pump may be generated due to various factors such as when the temperature of a portion around the fuel pump for delivering the fuel to the metering chamber becomes elevated due to the heat of the engine, the pressure of the fuel increases, the fuel then is fed into a discharger chamber, and the pressure of the fuel decreases, so that fuel vapor is generated within the metering chamber. In particular, a fuel vapor bubble may be generated due to elevated environmental temperatures during summer time so as to create a problem.

If the bubble of the generated fuel vapor is introduced to the metering chamber, and is delivered to an intake passage from a main nozzle or the like, a reduction of engine speed and an engine stoppage may occur due to a lean air-fuel mixture. In Japanese Unexamined Patent Publication No. H09-158806, a technique for suppressing a high negative pressure within a pulse chamber is described in a no load or low load operation region and eliminating an excessive increase of a fuel discharge pressure by connecting an upstream portion of a throttle valve of a carburetor intake passage to a pulse chamber of a fuel pump in a structure which uses a pulsation pressure of an intake pipe as a driving force of the fuel pump.

Further, in Japanese Unexamined Patent Publication No. 2000-297702, a means for discharging a fuel vapor stored in an upper portion of a metering chamber of a carburetor is described. The means for discharging fuel vapor is a purge pump which uses a pulsation pressure of an intake pipe as a driving force. In Japanese Unexamined Patent Publication No. 2003-166444, structure is described for withdrawing and discharging a fuel vapor to an intake passage by opening one end of a bubble evacuating passage to a downstream portion of a fuel inflow control valve of a fuel passage flowing into a metering chamber, opening the other end to a midsection of the fuel passage connected to a main nozzle from the metering chamber, and utilizing a specific gravity difference between the fuel vapor and the fuel to remove the fuel vapor.

Nevertheless, the technique described in Japanese Unexamined Patent Publication No. H09-158806 may not be applied to a structure using the pulsation pressure of the crank chamber as the driving force of the fuel pump. Further, the technique described in Japanese Unexamined Patent Publication No. 2000-297702 and the technique described in Japanese Unexamined Patent Publication No. 2003-166444 may not completely eliminate the problem that the fuel vapor is discharged to the intake passage from the upper portion of the metering chamber so as to make the air-fuel mixture excessively lean, and create a risk that the fuel pressure within the metering chamber becomes unstable.

SUMMARY OF THE INVENTION

A need has arisen for a diaphragm-type carburetor which solves the problems mentioned above. Further, a need has arisen for a diaphragm-type carburetor which prevents an air-fuel mixture from becoming excessively lean and prevents a fuel pressure from becoming unstable, thereby making it possible to stably supply a fuel to an engine, in a diaphragm-type carburetor with a pressure regulating means.

In accordance an embodiment of the invention, a diaphragm-type carburetor comprises:

a fuel pump using a pulsation pressure generated in a crank chamber of an engine or an intake pipe, as a driving force; and a metering chamber having a diaphragm and a lever mechanism and provided with fuel at a desired constant pressure, wherein the diaphragm-type carburetor comprises:

a bubble discharge path connecting the metering chamber to at least one other predetermined discharge portions and provided with a check valve in each of an inlet side and an outlet side; and a pump mechanism connected to the bubble discharge path, for withdrawing the bubble to the bubble discharge path from the metering chamber in conjunction with a closing operation of a throttle shaft by a driver, and for discharging the withdrawn bubble to the discharge portion in conjunction with an opening operation of the throttle shaft.

As mentioned above, on the basis of a comparatively uncomplicated structure in which the pump mechanism executing the suction and discharge operations in conjunction with the opening and closing operations of the throttle is arranged in the bubble discharge path, it is possible to securely discharge the bubble of the fuel vapor stored within the metering chamber without utilizing the pulsation pressure generated by the engine. The discharged portion of the bubble may be sent to the other spaces, such as a fuel tank or the like, other than the metering passage, and because the discharge timing is the valve opening time of the throttle, the engine operation is not significantly affected by discharging the bubble to the intake passage.

Further, the carburetor may be configured, such that the pump mechanism is connected to the bubble discharge path, the bubble is withdrawn to the bubble discharge path from the metering chamber in conjunction with the opening operation of the throttle shaft, and the withdrawn bubble is discharged to the discharge portion in conjunction with the closing operation of the throttle shaft.

Thus, it is an advantage of the present invention that it is possible to prevent the air-fuel mixture from becoming excessively lean and to prevent the fuel pressure from becoming unstable. Therefore, the carburetor may stably supply the fuel to the engine and improve engine operation.

Further objects, features, and advantages of the present invention will be understood from the following detailed description of preferred embodiments of the present invention with reference to the accompanying figures.

BRIEF DESCRIPTION OF THE DRAWINGS

Embodiments of the invention now are described with reference to the accompanying figures, which are given by way of example only, and are not intended to limit the present invention.

DESCRIPTION OF PREFERRED EMBODIMENTS

Figure 1:
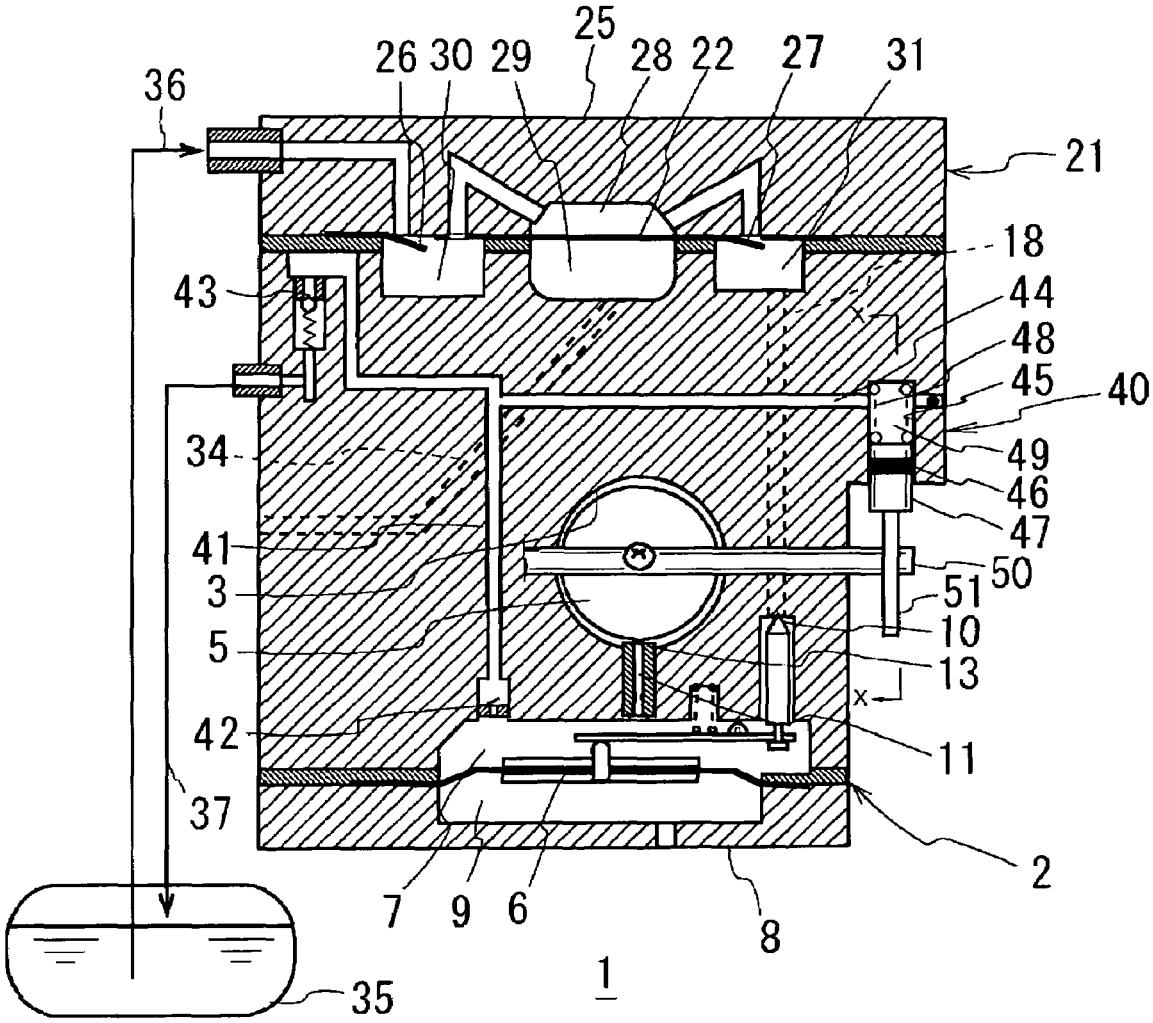
FIG. 1 is a cross-sectional view depicting an embodiment in accordance with the present invention.

A description will be given of a preferred embodiment of the present invention with reference to the accompanying drawings. As shown by a cross-sectional view in FIG. 1, a main body 2 of a diaphragm-type carburetor 1 has a transverse intake passage 3 provided with a throttle valve 5, and a metering chamber 7 may be disposed in a lower surface of the main body 2. The metering chamber 7 is separated from an atmospheric air chamber 9 within a diaphragm cover 8 by a diaphragm 6. Fuel is fed into metering chamber 7 from a fuel pump 21 through an inlet valve 10 opened and closed in correspondence to a displacement of diaphragm 6, and the fuel is discharged to intake passage 3 from a main nozzle 13 through a main fuel passage 11.

A pump diaphragm 22 and a pump cover 25 are arranged in stacks in the main body 2, and an inlet check valve 26 and an outlet check valve 27 are formed in pump diaphragm 22. Further, a pulse chamber 29 is disposed in main body 2 side with respect to pump diaphragm 22, a pump chamber 28 is formed in pump cover 25 side, a suction chamber 30 is disposed in main body 2 side on an upstream side of pump chamber 28, and a discharge chamber 31 is disposed in the main body 2 side in a downstream side of pump chamber 28, whereby fuel pump 21 comprises these elements.

A pulsation pressure generated in the crank chamber of the engine or the intake pipe is introduced to pulse chamber 29 through a pulse passage 34. Further, fuel in a fuel tank 35 is drawn into the pump chamber 28 via inlet check valve 26 and into suction chamber 30 through a suction passage 36, is pressurized so as to enter into discharge chamber 31 from outlet check valve 27, and is fed into metering chamber 7 from a feed passage 18 via inlet valve 10. A configuration of the diaphragm type carburetor 1 in which fuel pump 21 mentioned above is assembled, and the operations thereof are the same as those of known carburetors.

In this embodiment, a bubble discharge path 41 is connected to a top wall side of metering chamber 7, and is connected to fuel tank 35 via a bubble return piping 37. A pump mechanism for withdrawing and discharging the bubble is connected to bubble discharge path 41.

Bubble discharge path 41 is configured, such that a check valve 42 is arranged in an inlet side and a check valve 43 in which a predetermined valve pressure is set by a spring is arranged in an outlet side. Further, pump passage 44 is branched at a midstream position of bubble discharge path 41 so as to be connected to bubble removing pump 40, thereby constituting a pump mechanism.

Bubble removing pump 40 comprises a cylinder 45 to which pump passage 44 is connected, a piston 47 which is inserted into cylinder 45 and is configured, such that a seal member 46 is arranged in an outer periphery of piston 47, and a spring 48 which is disposed in cylinder 45 and urges piston 47 to open pump passage 44 and a space formed by an upper surface of piston 47 and an inner surface of cylinder 45 forms a pump chamber 49. Further, a cam 51 provided in an end of a throttle shaft 50 is brought into contact with a bottom surface of piston 47, and piston 47 is moved up and down in configuration with an opening and closing operation of throttle shaft 50.

Figure 2A:
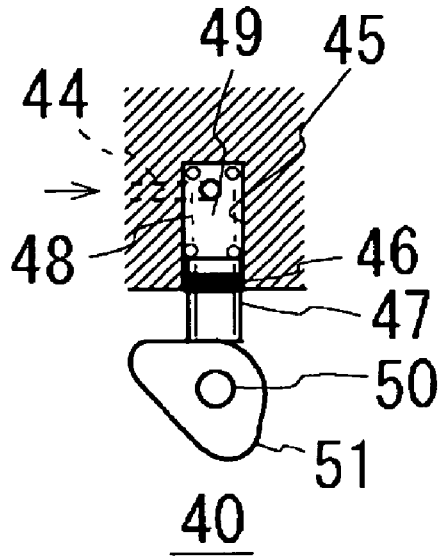
FIG. 2A is a partial, cross-sectional view along a line X-X in FIG. 1 and depicts a configuration during a suction operation of a bubble removing pump.
Figure 2B:
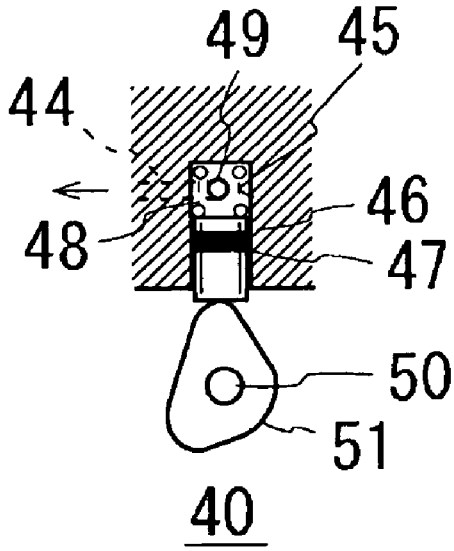
FIG. 2B is a partial, cross-sectional view along the line X-X in FIG. 1 and depicts a configuration during a discharge operation of the bubble removing pump.

A detailed description of a bubble withdrawal and discharge operation within metering chamber 7 now is provided corresponding to the features of the present embodiment with reference to a cross-sectional view of diaphragm-type carburetor 1 in FIG. 1. FIGS. 2A and 2B depict partial, cross-sectional views of bubble removing pump 40 portion along a line X-X in FIG. 1.

The bubble of the fuel vapor introduced to or generated within the metering chamber 7 due to various factors collects in a top wall side, e.g., an upper portion, of metering chamber 7 on the basis of a specific gravity difference from the liquid fuel. With reference to FIG. 2A, when a driver or operator turns throttle shaft 50 to operate the throttle in a closing direction, a protruding portion of cam 51 provided in an end side of throttle shaft 50 is moved transversely, and piston 47 is urged out of cylinder 45, e.g., downward, due to energizing force of spring 48.

Because a volume of pump chamber 49 within cylinder 45 increases and an internal pressure declines, the bubble in metering chamber 7 is withdrawn into bubble discharge path 41 via pump passage 44. At this time, check valve 43 in the outlet side of bubble discharge path 41 is closed, and the fuel and the fuel vapor are not withdrawn from fuel tank 35.

Further, with reference to FIG. 2B, when the driver or operator turns throttle shaft 50 to operate the throttle in an opening direction, the protruding portion of cam 51 is moved upward, and pushes piston 47 into cylinder 45, e.g., upward, against the energizing force of spring 48. Accordingly, because the volume of pump chamber 49 decreases and the internal pressure increases, the pressure within bubble discharge path 41 increases via pump passage 44, and the withdrawn bubble is discharged against the valve pressure of check valve 43. At this time, because check valve 42 in the inlet side of bubble discharge path 41 is closed, the bubble is not reintroduced the metering chamber 7.

As mentioned above, the bubble collected within metering chamber 7 is forcibly withdrawn and removed so as to be discharged to fuel tank 35, in conjunction with the opening and closing operation of throttle shaft 50 by the driver or operator without utilizing the pulsation pressure by the engine. Accordingly, the bubble in the supplied fuel may be eliminated so as to stably supply the fuel to the engine without significantly affecting the fuel pressure within metering chamber 7, as well as preventing the discharged bubble from making the air-fuel mixture in intake passage 3 excessively lean. Further, as soon as the bubble is removed from metering chamber 7, fresh fuel is supplied from inlet valve 10, and metering chamber 7 is readily maintained at a constant pressure.

In this case, because the spring is arranged in outlet side check valve 43 of bubble discharge path 41 so as to establish a predetermined valve pressure, communication with fuel tank 35 is interrupted during constant speed operation, i.e., when bubble removing pump 40 is not operated, so that an outflow of the fuel and an inflow of the bubble do not occur.

Figure 3A:
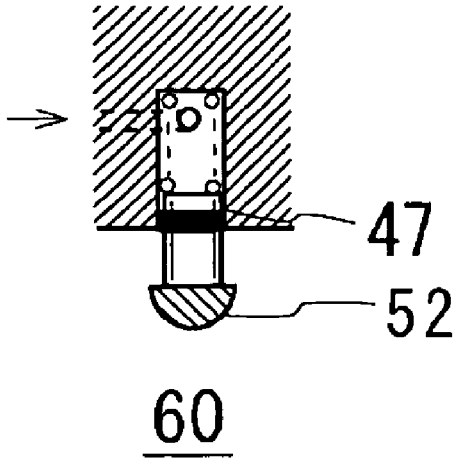
FIG. 3A is a partial, cross-sectional view showing a different aspect of the bubble removing pump in FIG. 2A.
Figure 3B:
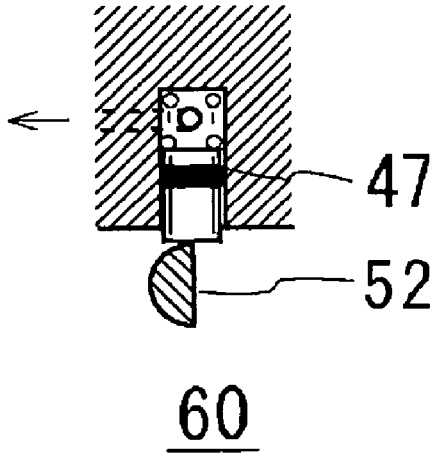
FIG. 3B is a partial, cross-sectional view showing a different aspect of the bubble removing pump in FIG. 2B.

Further, as shown in FIGS. 3A and 3B, even in a bubble removing pump 60 in which cam 51 is not provided in the end of throttle shaft 50, and a throttle shaft 52 is formed by cutting the shaft itself in a cam shape, the same functions as mentioned above may be achieved. In accordance with the configuration described above, a reduction of a manufacturing cost by reducing the complexity of the structure of the apparatus.

Further, the foregoing description is given of the case in which the space in the discharge portion of the bubble is formed by fuel tank 35. Nevertheless, the discharge portion may be achieved in the same manner as described above by being formed by the other spaces not substantially affecting the engine operation, for example, an upstream side of the suction passage which has less relation with a metering passage of the fuel, or the like.

In the present embodiment, the pump mechanism withdraws the bubble to the bubble discharge path from the metering chamber in conjunction with the closing operation of the throttle shaft and discharging the withdrawn bubble to the discharge portion in conjunction with the opening operation of the throttle shaft. Nevertheless, a pump mechanism may withdraw the bubble to the bubble discharge path from the metering chamber in conjunction with the opening operation of the throttle shaft and discharging the sucked bubble to the discharge portion in conjunction with the closing operation of the throttle shaft in the same manner.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A diaphragm carburetor comprising:

a fuel pump using a pulsation pressure generated in a crank chamber of an engine or an intake pipe, as a driving force; and a metering chamber having a diaphragm and a lever mechanism and provided with fuel at a desired constant pressure, wherein the diaphragm-type carburetor comprises:

a bubble discharge path connecting the metering chamber to at least one other predetermined discharge portion and provided with a check valve in each of an inlet side and an outlet side; and a pump mechanism connected to the bubble discharge path, for withdrawing the bubble to the bubble discharge path from the metering chamber in conjunction with a closing operation of a throttle shaft by a driver and for discharging the withdrawn bubble to the discharge portion in conjunction with an opening operation of the throttle shaft.

2. The diaphragm carburetor of claim 1, wherein a communication with a fuel tank is interrupted at a time when the pump mechanism is not operated, by a spring arranged in the outlet side check valve.

3. The diaphragm carburetor of claim 1, wherein a cam is disposed in the throttle shaft itself.

4. The diaphragm carburetor of claim 1, wherein the discharge portion comprises a fuel tank.

5. The diaphragm carburetor of claim 1, wherein the discharge portion comprises an upstream side of an intake passage.

6. A diaphragm carburetor comprising:

a fuel pump using a pulsation pressure generated in a crank chamber of an engine or an intake pipe, as a driving force; and a metering chamber having a diaphragm and a lever mechanism and provided with fuel at a desired constant pressure, wherein the diaphragm-type carburetor comprises:

a bubble discharge path connecting the metering chamber to at least one other predetermined discharge portion and provided with a check valve in each of an inlet side and an outlet side; and a pump mechanism connected to the bubble discharge path, for withdrawing the bubble to the bubble discharge path from the metering chamber in conjunction with an opening operation of a throttle shaft by a driver and for discharging the withdrawn bubble to the discharge portion in conjunction with a closing operation of the throttle shaft.

7. The diaphragm carburetor of claim 6, wherein a communication with a fuel tank is interrupted at a time when the pump mechanism is not operated, by a spring arranged in the outlet side check valve.

8. The diaphragm carburetor of claim 6, wherein a cam is disposed in the throttle shaft itself.

9. The diaphragm carburetor of claim 6, wherein the discharge portion comprises a fuel tank.

10. The diaphragm carburetor of claim 6, wherein the discharge portion comprises an upstream side of an intake passage.

* * * * *